United States Patent [19]

Lichtenstein

[11] Patent Number: 4,913,430

[45] Date of Patent: Apr. 3, 1990

[54] TENNIS RACKET STRINGS HAVING ORTHOGONALLY DIRECTED PROTRUSIONS FOR ENHANCING THE GRIP WHEN IN CONTACT WITH A TENNIS BALL

[76] Inventor: Leo Lichtenstein, 1950 Tarpon Ct., Wesley Chapel, Fla. 34249

[21] Appl. No.: 145,988

[22] Filed: Jan. 20, 1988

[51] Int. Cl.[4] ..... A63B 51/10

[52] U.S. Cl. ..... 273/73 D

[58] Field of Search ..... 273/73 R, 73 C, 73 D, 273/73 A, 73 B

[56] References Cited

U.S. PATENT DOCUMENTS

| | | | |
|---|---|---|---|
| 763,059 | 6/1904 | Hyde | 273/73 D |
| 1,364,331 | 1/1921 | Vaile | 273/73 D |
| 1,422,993 | 7/1922 | Larned | 273/73 D |
| 3,630,523 | 12/1971 | Lacoste | 273/73 D |
| 3,921,979 | 11/1975 | Dischinger | 273/73 D X |
| 4,368,886 | 1/1983 | Graf | 273/73 D |

FOREIGN PATENT DOCUMENTS

| | | | |
|---|---|---|---|
| 2633070 | 1/1978 | Fed. Rep. of Germany | 273/73 D |
| 2642694 | 3/1978 | Fed. Rep. of Germany | 273/73 D |
| 2642978 | 3/1978 | Fed. Rep. of Germany | 273/73 D |
| 781609 | 2/1935 | France | 273/73 D |
| 331925 | 7/1930 | United Kingdom | 273/73 D |

*Primary Examiner*—Edward M. Coven
*Assistant Examiner*—William E. Stoll
*Attorney, Agent, or Firm*—Antonelli, Terry & Wands

[57] ABSTRACT

A racket having intersecting strings is disclosed in conjunction with a plurality of orthogonal protrusions made from metallic wires extending through and fixedly positioned at the intersections of the strings for the purpose of enhancing the frictional grip between the racket and the ball during impact. This construction makes it easier to execute "drop shots", "slicing strokes", "top spin" and "under spin" shots. The protrusions allow greater ball control as well as prolonging the life of the strings. The wire protrusions produce a gripping action having better frictional contact between the strings of the racket, such as a tennis racket, and the ball when it is hit. The protrusions can be provided on one as well as both sides of the intersections along the same axial line, such as, by twisting the wires and forming protrusion end surfaces that are substantially parallel to the surface of the plane of the strings with a tooth-like gripping action and improved ball control.

2 Claims, 1 Drawing Sheet

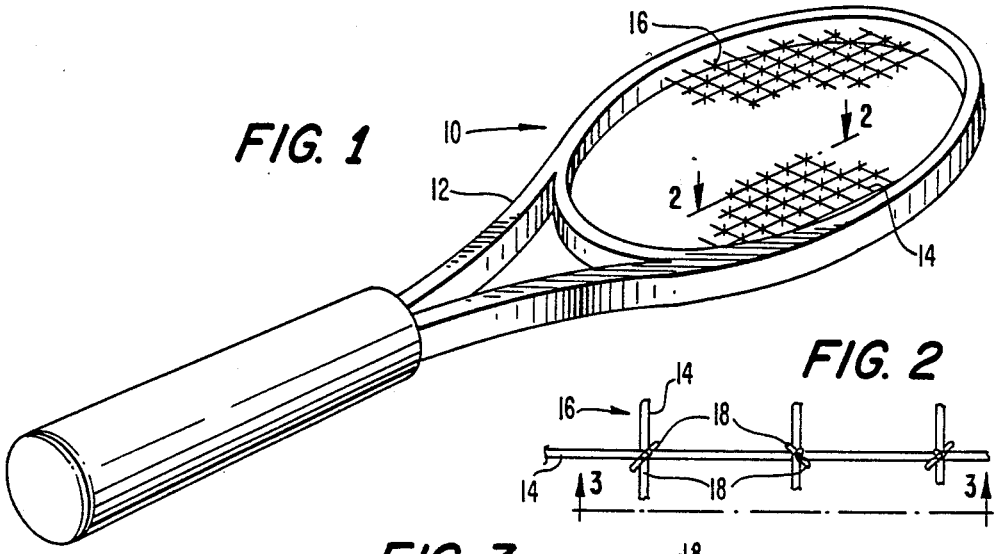
FIG. 1
FIG. 2
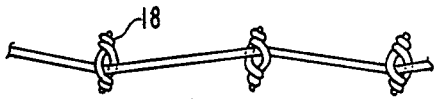
FIG. 3
FIG. 4
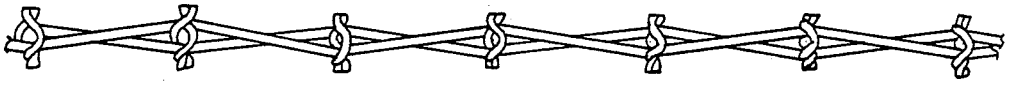
FIG. 5
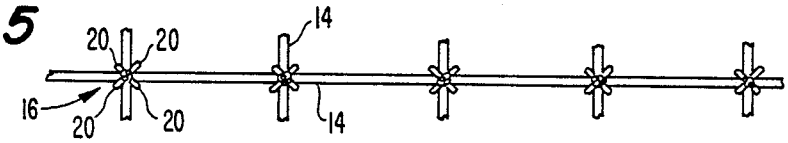
FIG. 6
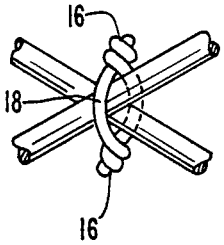
FIG. 7
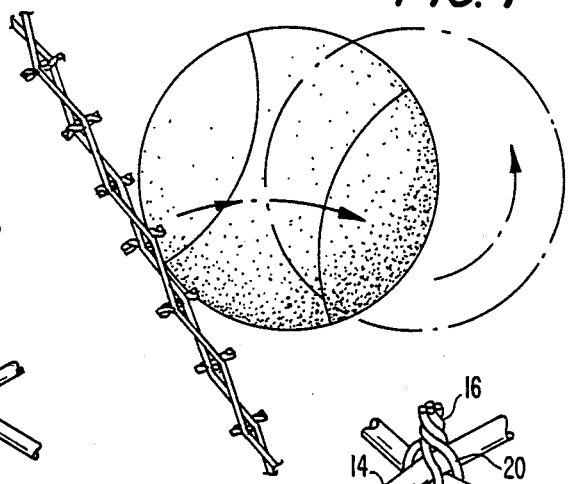
FIG. 8
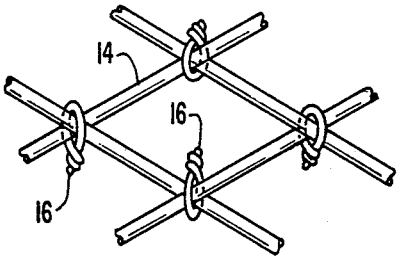
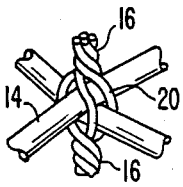
FIG. 5A

TENNIS RACKET STRINGS HAVING ORTHOGONALLY DIRECTED PROTRUSIONS FOR ENHANCING THE GRIP WHEN IN CONTACT WITH A TENNIS BALL

BACKGROUND OF THE INVENTION

1. Field of the Invention

The present invention relates to tennis rackets having intersecting strings combined with protrusions for enhancing the frictional grip between the racket and the ball for effecting greater directional ball control as well as extending the useful life of the racket strings.

2. Description of the Prior Art

Being able to accurately control the placing of the ball when hit by the racket as well as the ball spin with greater facility makes it easier for the average tennis player to execute certain type of shots effectively. When a player is able to control the placing of the ball as well as the spin of a tennis ball with greater precision, the player can improve certain types of shots including "drop shots", "slicing strokes", "top-spin" as well as "under spin" shots.

Tennis rackets have previously been designed with protrusions for affecting greater control of the spin of the ball upon impact with the racket strings to result in greater directional control. In addition, there have also been earlier attempts at reducing friction between the intersecting strings caused by the impact of the ball on the intersecting strings, such as, by reducing or preventing sliding of one string with respect to the transversely directed string at the string intersections.

Examples of prior art concerned with improving ball control including spinning as well as lengthening the life of the tennis racket strings include the following patents. U.S. Pat. No. 763,059 to J. E. Hyde et al. incorporates knots at intervals along lengths of individual strings as well as at the intersections of the strings, as illustrated in FIG. 5 U.S. Pat. No. 1,682,199 to R. H. Smilie interposes a double concave disc at the intersections of the racket strings for better absorption of the ball impact force as well as reducing sliding of the strings themselves. Smilie also uses rubber type wedge grooves in order to improve gripping of the ball. U.S. Pat. No. 1,531,778 to E. F. Gallaudet discloses twine which is wrapped over the intersections of the tennis racket strings in order to prolong the life of the strings as well as for greater ball gripping control. British patent No. 331,925 to F. W. Donisthorpe discloses using an adhesive at the intersections of the racket strings for preventing wear and tear of the strings at those locations. U.S. Pat. No. 4,095,790 to Swiecicki increases the friction grip of the racket strings on the tennis ball by including protuberances on the intersections of the strings. In addition, the following patents and article also pertain to the design of tennis racket strings: U.S. Pat. Nos. 3,926,431, 4,078,796 and 4,349,198; Sports Illustrated article, "A Weighty Matter of Spagletti and Tennis Balls" by J. D. Reed, Apr. 3, 1978.

SUMMARY OF THE INVENTION

The present invention is an improved tennis racket which has protrusions formed by a combined set of wires disposed at the intersections of the strings of a tennis racket to improve the frictional grip between the racket and the ball in order to make it easier to execute "drop shots", "slicing strokes", "top spin" and "under spin" shots, which are well known tennis shots. In addition, the type of protrusions improve the gripping control of the ball with the result of greater precision in the directional control as well as the spinning control of the ball during play. This is as a result of the teeth-like gripping provided by orthogonally directed wire protrusions. Furthermore, securing the intersections of the tennis racket strings by twisted wire protrusions also avoids creeping and sliding action of the strings as well as preventing a direct hit on the string intersections by the ball when playing tennis.

The protrusions at the intersections of the interlaced strings prevent any movement such as sliding or rubbing of the strings against each other preventing wear and tear on the strings, hence, greatly extending the life of the racket strings.

According to the present invention, the metal protrusions on the racket strings also greatly enhance spinning control of the ball, the ability to control the trajectory of the ball while moving through the air as well as controlling the bouncing action of the ball when it hits the tennis court surface.

The above protrusions are implemented by combining wires, such as by twisting at the respective intersections of the tennis racket strings which provide orthogonal protrusions having ends that are substantially parallel with the plane defined by the intersecting strings of the tennis racket. The protrusions of the present invention may be located on one or both sides of the racket.

The present invention has a plurality of intersecting strings which define a plane and has a plurality of sets of wires, each set has wires combined and extending through an intersection of the strings in an orthogonal direction from the plane or a single wire bent in the form of a U-shape with its sides intersecting the strings through diagonally opposite quadrants, combined and extending in an orthogonal direction from the plane for providing at least one orthogonal protrusion. The present invention has a plurality of pairs of wires with each pair being combined and extending through an intersection of the strings in a orthogonal direction from the plane of the intersecting strings or a plurality of single wires each bent in the form of a U-shape with its sides intersecting the strings through diagonally opposite quadrants combined and extending in an orthogonal direction from the plane for providing at least one orthogonal protrusion. The wires or the ends of the U-bent wire can be combined in the form of twisted wires having a protrusion end surface which is substantially parallel to the plane of the intersecting strings and wherein the respective protrusions are fixedly positioned at the intersections of the strings.

Furthermore, according to the present invention, the wires are combined with a permanent connection to intersections of the strings. This enhances the longevity of the strings by precluding any relative movement of the strings at the intersections as well as avoiding the impact of the intersecting strings on each other caused by a direct hit by the ball which would adversely affect the life of the strings, especially near the vicinity of the intersections.

An improved tennis racket according to the present invention can also be produced with tennis rackets that have already been manufactured. The wire protrusions, which may include one wire bent in the form of the letter U or a set of two as well as a set of four wires at each intersection of the strings, can be added to tennis rackets that have already been manufactured since, there is no required alteration of the strings.

BRIEF DESCRIPTION OF THE DRAWINGS

FIG. 1 illustrates a perspective view of a tennis racket according to the present invention.

FIG. 2 illustrates an enlarged view of a section of the intersecting strings along lines 2—2 of FIG. 1 according to a first embodiment of the present invention.

FIG. 3 illustrates a side elevation view along lines 3—3 of FIG. 2.

FIG. 4 illustrates an enlarged cross-sectional view of a second embodiment according to the present invention.

FIG. 5 illustrates an enlarged fragment along lines 2—2 of FIG. 1 according to a third embodiment of the present invention.

FIG. 5A illustrates a perspective view of an enlarged fragment illustrating a single intersection of the strings of a tennis racket showing four twisted wires for forming the orthogonal protrusions in accordance with the third embodiment of the present invention.

FIG. 6 shows a perspective view of an enlarged fragment illustrating a single intersection of the strings of a tennis racket showing a pair of twisted wires for forming the orthogonal protrusions in accordance with the first embodiment of the present invention.

FIG. 7 illustrates an example of the gripping action of the improved tennis racket according to the present invention for controlling the direction of motion and spinning of a tennis ball when it is hit by the racket.

FIG. 8 illustrates an enlarged perspective view of a fourth embodiment according to the present invention.

DESCRIPTION OF THE PREFERRED EMBODIMENTS

FIG. 1 illustrates a typical tennis racket 10 having a frame 12 and with intersecting strings 14 within the circumference of the frame of the tennis racket. FIG. 1 further illustrates orthogonal protrusions 16 which may extend on both sides of a plurality of the string intersections, along the same axial line. The protrusions 16 can be applied to all of the string intersections or only to the central portion known in tennis circles as the "sweet spot" of the racket. Alternatively, the protrusions may be applied to every other intersection, or can be implemented in other arrangements within the intersecting strings. The protrusions 16 are provided by fixedly placing a set of wires at a plurality of intersections which extend through respective quadrants of the intersections in an orthogonal direction with respect to the plane defined by the intersecting strings and combining the wires, such as but not limited to twisting them and forming at the outer protrusion end surfaces that are substantially parallel to the plane of the respective intersecting string surfaces.

A first embodiment of the present invention is illustrated in FIGS. 2 and 3. FIG. 2 illustrates protrusions 16 consisting of a pair of wires 18 fixedly placed through two of the four diagonal quadrants formed by the orthogonal intersection of the strings 14 at each respective intersection with any two adjacent intersections having wires in a different pair of the four diagonal quadrants. The wires 18 are combined according to the illustration in FIG. 3 as well as in FIG. 6 by being twisted and directed to form orthogonal protrusions 16.

FIG. 4 illustrates an enlarged cross-section of a second embodiment according to the present invention wherein all the wires that are combined by twisting in a single direction, i.e. either clockwise or counterclockwise.

FIGS. 5 and 5*a* illustrate a third embodiment according to the present invention having cross ties around each intersection of the strings 14 by combining four wires 20 by twisting in order to form the orthogonal protrusions. Each of the four quadrants defined by the orthogonal intersection of the strings 14 has one of the wires 18 located therein.

FIG. 7 illustrates an example of the effect on the ball when it is hit by a tennis racket implementing the protrusions 16 according to the present invention with the advantages incurred as a result thereof, as previously described. Specifically, increased spin and directional control are produced.

FIG. 8 illustrates a fourth embodiment according to the present invention using a single wire to effect the individual orthogonal protrusions 16. This is achieved by extending the wire through one of the quadrants formed by the intersections, bending the wire and returning the wire through an opposite quadrant and extending it outwardly, forming a U-shape, and combining both sides by twisting to form an orthogonally directioned protrusions at the string intersection.

The protrusions 16 according to the present invention can be applied to all conventional string rackets, including rackets that are already in use as well as those to be manufactured. The wire protrusions according to the present invention can be implemented by using, for example, steel wires, stainless steel wires, brass, aluminum, as well as other types of metal wires. In addition, the metal wires can be round or have another type of configuration. The wire protrusions 16 can be applied on the intersections of the strings by firmly twisting the wire ends on each side of the racket in all four quadrants defined by the intersection of the strings when using four wires, or on the diagonally opposite quadrants when using two wires in order to form strong and stable, i.e. durable protrusions. Furthermore, in order to add additional durability as well as permanence to the fixedly positioned protrusion wires, glue or any other type of adhesive may be applied to the intersections as well as to the protrusions to fuse the strings and the wires together. The metallic material of the wires should be such that the protrusions formed will be strong enough and stable have sufficient to resist against any deformation as a result of contact with a moving ball. The protrusions can be implemented on a tennis racket by using a single wire extending through one of the quadrants formed by the intersections, bending the wire and returning the wire through an opposite quadrant and extending it outwardly, and combining it with the other side of the same wire as, for example, by twisting and forming a protrusion in a orthogonal direction to the plane surface of the plane. In this last example, only one outwardly directed orthogonal protrusion is provided with respect to each intersection of the strings in a racket so that only one side of the tennis racket strings would have orthogonal protrusions when all of the protrusions are orthogonally directioned away from the same plane.

While the invention has been described in terms of its preferred embodiments, numerous modifications may be made thereto without departing from the spirit and scope of the invention. It is intended that all such modifications fall within the scope of the appended claims.

I claim:

1. A racket comprising:

a frame;

a plurality of strings mounted on the frame to form a plane;

a plurality of strings interlaced to form a plurality of intersections in the plane;

a plurality of sets of metallic wires, each set of wires being comprised of four metallic wires respectively extending through individual quadrants formed by the intersection of strings and combined to from a pair of fixedly positioned twisted wire protrusions orthogonally extending along a common axis outwardly from both sides of the plane, wherein the twisted wire protrusions have end surfaces which are substantially parallel to the plane and the protrusions are resistant to deformation caused by contact with a ball during play; and wherein the four metallic wires extend through the four quadrants to prevent movement of the strings against each other and provide the protrusions with a resistance to deformation and the end surfaces of the protrusions enhance spin control of a ball hit by the racket.

2. A racket according to claim 1, wherein each set of wires is permanently connected to an intersection of the strings.

* * * * *